US005330398A

United States Patent [19]

Barbafieri et al.

[11] Patent Number: 5,330,398

[45] Date of Patent: Jul. 19, 1994

[54] GALLOWS FOR SPORT GYMNASTICS WITH RIGID RING SUSPENSION

[76] Inventors: Gerard Barbafieri; Henry Miceli, both of 16 Bd Faidherbe, Marseille 13012, France

[21] Appl. No.: 856,970

[22] PCT Filed: Dec. 11, 1990

[86] PCT No.: PCT/FR90/00899

§ 371 Date: May 20, 1992

§ 102(e) Date: May 20, 1992

[87] PCT Pub. No.: WO91/08800

PCT Pub. Date: Jun. 27, 1991

[30] Foreign Application Priority Data

Dec. 13, 1989 [FR] France ..... 89 16756
May 22, 1990 [FR] France ..... 90 06675

[51] Int. Cl.[5] ..... A63B 7/02
[52] U.S. Cl. ..... 482/23; 482/24
[58] Field of Search ..... 472/32, 12, 49, 43, 472/48, 118, 122; 482/23, 24, 33–43, 91

[56] References Cited

U.S. PATENT DOCUMENTS

| | | | |
|---|---|---|---|
| 425,636 | 4/1890 | Shaw | 482/23 |
| 793,331 | 6/1905 | Thornley | 482/24 |
| 2,197,600 | 4/1940 | Wimer | 482/24 |
| 3,432,163 | 3/1969 | Murphy | 482/23 |
| 3,653,658 | 4/1972 | Robertson | 482/23 |
| 4,334,675 | 6/1982 | Parry et al. | 482/23 |
| 4,410,175 | 10/1983 | Shamp | 482/33 |
| 4,738,444 | 4/1988 | Linden | 482/24 |
| 5,013,034 | 5/1991 | March et al. | 482/115 |

FOREIGN PATENT DOCUMENTS

| | | | |
|---|---|---|---|
| 2330184 | 1/1975 | Fed. Rep. of Germany . | |
| 3228823 | 2/1984 | Fed. Rep. of Germany . | |
| 1252671 | 11/1971 | United Kingdom | 482/24 |

OTHER PUBLICATIONS

International Search Report.
International Preliminary Examination Report in English.

*Primary Examiner*—Richard J. Apley
*Assistant Examiner*—Jerome Donnelly
*Attorney, Agent, or Firm*—Sandler, Greenblum & Bernstein

[57] ABSTRACT

Gallows for rings, intended to be used in sport gymnastics, wherein the cross beam is more flexible than conventionally known models. The cross beam is hinged to the uprights of the gallows with a silentblock or rubber piece. The rings of the gallows are connected to the cross beam using rigid rods made of a composite material or other rigid material, with the rigid rods being connected at their tops by a self-locking trunnion provided with a universal joint and fixed to the rings by a short link of textile material. Also, the bottom of the uprights of the gallows are connected by a cable.

20 Claims, 3 Drawing Sheets

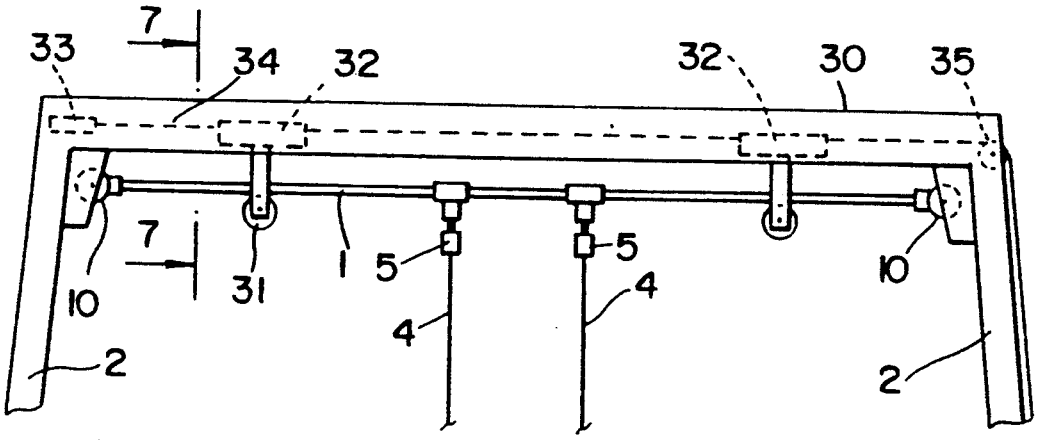
Fig- 5
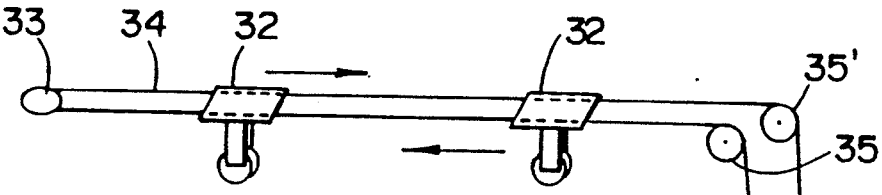
Fig- 6
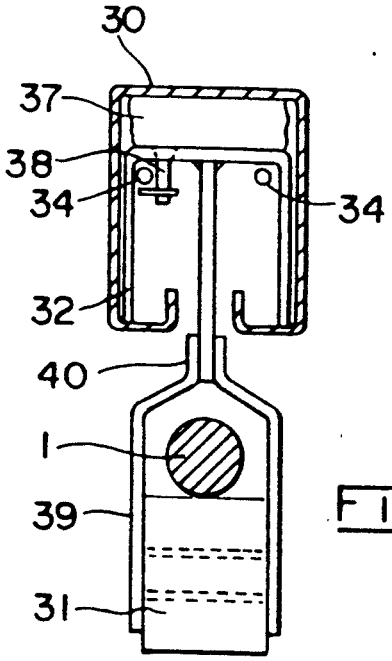
Fig- 7
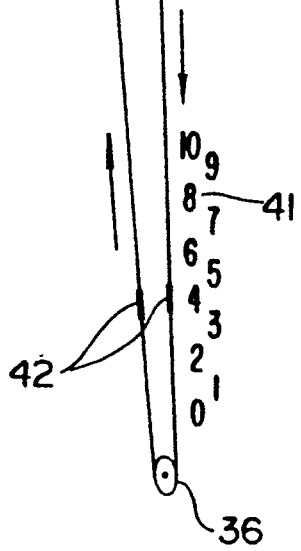

GALLOWS FOR SPORT GYMNASTICS WITH RIGID RING SUSPENSION

BACKGROUND OF THE INVENTION

Ring gallows adapted for gymnastic competition and used currently have functional dimensions that are determined by the International Federation of Gymnastics.

These functional dimensions are related to height, from the ground to the top of the gallows, to the length of the cable system and straps connecting the rings to the cross beam at the top of the gallows by means of thrust ball bearings enabling permanent axial rotation of the cables on which the rings are hooked, and adapted to provide total liberty to the gymnast as he moves about the ring.

Currently known gallows have uprights that allow the totality of the gallows to flex during a particularly energetic exercise.

The major disadvantage of this gymnastic apparatus, both by reason of its conception and in view of the evolution of gymnastics, is its rigidity, which results in trauma at the level of the spinal column (at the level of the vertebrae) and at the level of the shoulders, and transmits all the vibrations from the uprights of the gallows and from the cable system to the body of the gymnast.

Additionally, ring exercises are limited by the fact that the gymnasts never let go of the rings, except when they exit.

This invention aims to overcome these disadvantages and enables exercises with this gymnastic apparatus to evolve, insofar as letting go and recapturing the rings before exiting is concerned.

The invention is characterized by four main points, namely:

1. The cross beam at the top is made of the same material, but is much longer, so that it alone flexes and provides flexibility, or it can be made of another material, either composite material, or hardened steel, etc.

2. The hinging of the top beam with the uprights mounted on a silentblock results not only in the provision of ampler flexibility, but also eliminates the residual vibrations of the uprights and the maintenance cables.

3. The cables connecting the top cross beam to the rings are replaced by a rigid junction made of fiberglass or another material, enabling a controlled swing during release, thus avoiding the latter from moving wildly in every direction.

4. The effect of the thrust ball bearings are voided when the gymnast releases the rings. The rings will stop in the exact rotational plane in which they were located at the moment of release, and this enables them to be recaptured easily.

Points 1 and 2 result in a considerable reduction of trauma.

Points 3 and 4 are adapted to help the exercises evolve (letting go of the rings for a dangerous exercise, with the possibility of recapturing them later).

BRIEF DESCRIPTION OF THE DRAWINGS

Other characteristics and advantages of this invention will appear more clearly from the non-limiting description below in reference to the attached drawings, in which:

FIG. 5 illustrates a flexible-ring bearing bar system according to the present invention;

FIG. 6 illustrates a synoptic drawing of the adjustment system of the flexible-ring bearing bar system of FIG. 5; and FIG. 7 illustrates a sectional view along A—A of the flexible-ring bearing bar system of FIG. 5.

FIG. 1 shows the gallows assembly of a trapezoidal shape constituted by:

Figure 1:
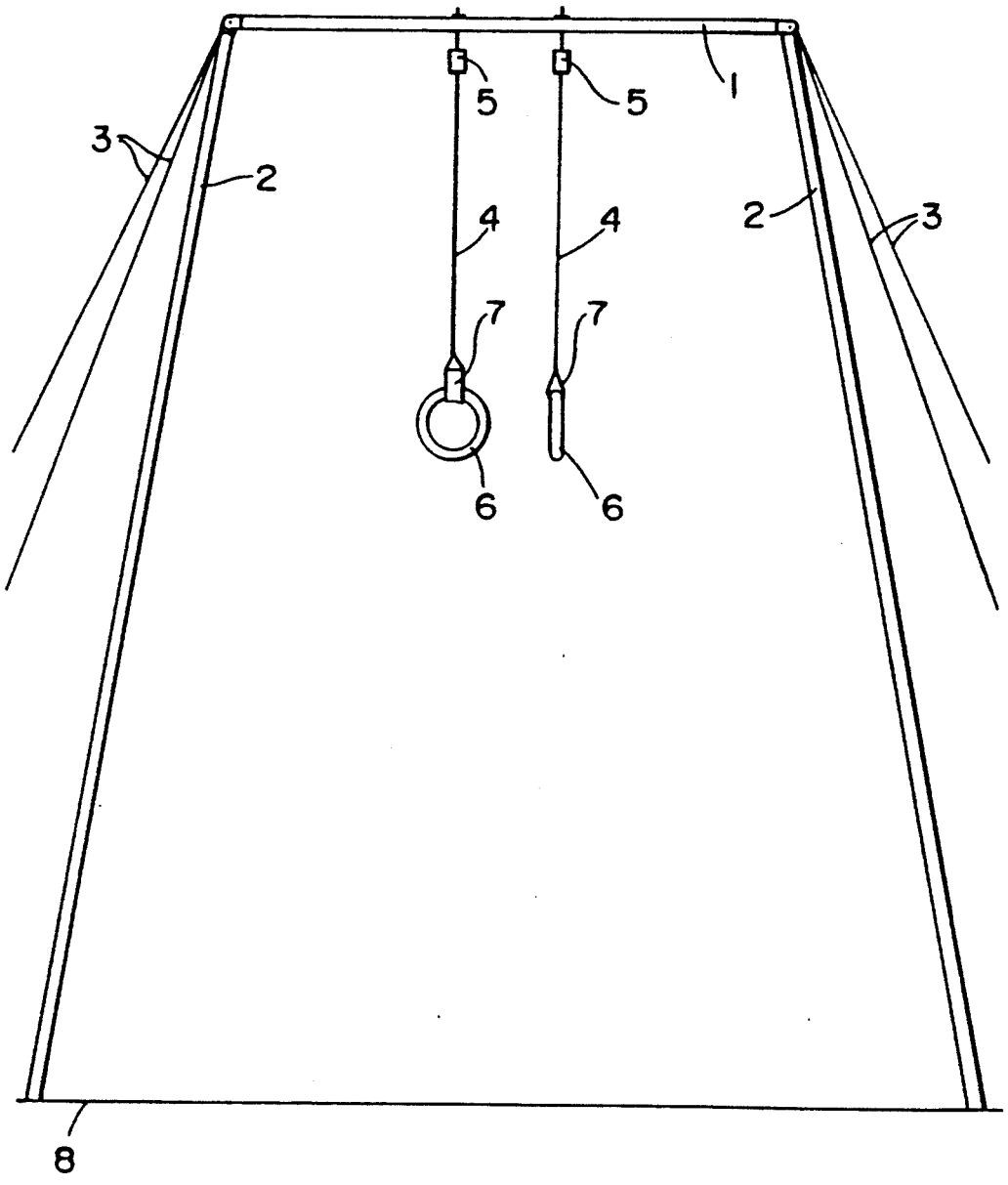
FIG. 1 illustrates a gallows assembly according to the present invention.

cross beam 1, uprights 2, maintenance cable system 3, fiberglass rods 4, thrust bearings 5, rings 6, textile link 7 between the rings and the fiberglass, cable 8 for maintaining the distance between the uprights.

Figure 2:
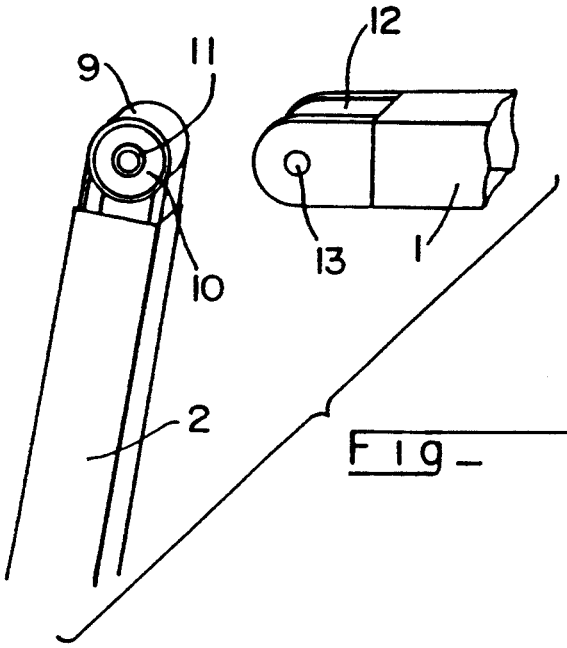
FIG. 2 illustrates a junction of one end of the cross beam with the top end of the upright according to the present invention.

FIG. 2 represents the junction of one end of the cross beam 1 with the top end of upright 2 constituted by a male cap 9 in which a silentblock 10 is housed (or an element made of hard rubber) slightly exceeding the two sides of its housing 9.

Element 11 is a metallic spacer that is used to avoid wear and tear of the rubber.

The female cap 12 will be affixed to male cap 9 by means of a bolt, not represented in the drawings, passing through hole 13 of the female cap and spacer 11 of the male cap.

The internal sides of the female cap 12 will be in contact with the rubber 10 that exceeds beyond male cap 9 and as such, will have no metallic contact with male cap 9. This will stop the transmission of vibrations from cables 3 and from upright 2 to cross beam 1.

Figure 3:
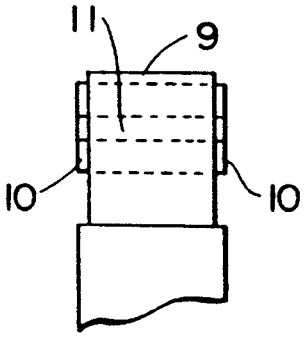
FIG. 3 illustrates a side view of male cap of FIG. 2.

FIG. 3 represents a side view of the male cap 9 showing the exceeding of rubber 10.

Figure 4:
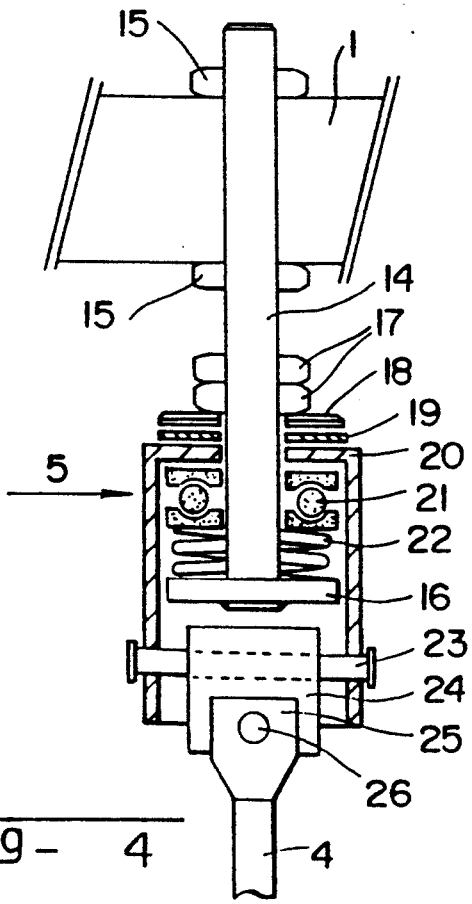
FIG. 4 illustrates the self-locking trunnion according to the present invention.

FIG. 4 shows the self-locking trunnion 5 for suspension of the rings.

The threaded rod 14 is fixed by nuts 15 to cross beam 1.

A washer 16 is welded in the lower portion of the threaded rod 14.

Nut and counter nut 17 are used to adjust the system.

Washer 18 is a friction washer.

Brake washer 19 is a rubber washer or it can be made of any other anti-skid material.

Portion 20 is the body of the system.

Portion 21 is a thrust ball bearing or rollers.

Spring 22 is partially compressed, without load, on the self-locking trunnion.

Elements 23, 24, 25, and 26 constitute the omni-directional portion (universal joint) connecting body 20 to fiberglass rod 4, enabling the latter and the ring to achieve an omni-directional swing.

Axes 23 and 26 are journal pivots of the universal joint represented by elements 24 and 25.

When the self-locking trunnion is not loaded (no suspended gymnast), spring 22 acts by separating washer 16 from thrust ball bearing 21, resulting in the contact of washer 18 with rubber washer 19, and the top of body 20 braking and neutralizing the effect of the thrust ball bearing 21. Thus, the trunnion is in a blocked, unloaded position.

When the trunnion is loaded (gymnast suspended from the rings), the load being transmitted to body 20 by means of the fiberglass rod 4 and the universal joint, body 20 rests on abutment 21, completely crushing spring 22 that comes into abutment on element 16, thereby rendering washer 19 inactive and enabling the abutment to take full effect, and the trunnion finds itself in free rotation. When loaded, the trunnion is unblocked.

The flexibility of the ring-bearing bar can be also be rendered adjustable, and this enables the same gallows to be used both for training exercises (maximum flexibility) and for competitive events (eliminated flexibility).

FIG. 5 shows the upper portion of the gallows arranged in this manner. Bar 30, very rigid, is a rail affixed in uprights 2 of the gallows.

Rollers 31 made of rubber, or any other shock-absorbing material, are mounted in free wheel on carriages 32, that are themselves slidable inside rail 30 and enable the flexional adjustment of beam 1, which will be translated into more or less flexibility for the gymnast.

One need only displace rollers 31 with respect to the fixing point of the fiberglass rods to increase or decrease flexibility.

When rollers 31 are against uprights 2, bar 1 flexes to a maximum, thus providing maximum flexibility. Inversely, when rollers 31 are against the fixing points of the fiberglass rods, all flexion is eliminated, and thus the gallows can be used in competitive events, in accordance with the current norms of the International Federation of Gymnastics.

Pulley 33, at the end of rail 30 is positioned horizontally and receives a cable 34 made of steel or a nautical-rope type textile, or "kevlar".

The two pulleys 35 and 35' of FIG. 6 that are located at the other end and positioned vertically with respect to the rail, also receive cable 34.

FIG. 6 shows a synoptic drawing of the adjustment system (of a curtain rod type).

Pulley 36 is in a lowered position, within hand's reach, on one of uprights 2.

Carriages 32 are fixed on either side of the hook of cable 34.

Cable 34 being positioned in a closed circuit on pulleys 33, 35, 35' and 36, when it is pulled either in one direction or another, carriages 32 are either distanced or come closer together. This enables a simple and quick adjustment in accordance with the desired flexibility. A graduating strip 41 is placed on upright 2. Grips 42 render the manipulation of adjustment more practical.

FIG. 7 shows a sectional view along 7—7 of the top of the gallows.

Polyurethane foam 37 (or any other material) are used to eliminate backlash and noise.

Screw 38 blocks cable 34 on one side. On the other side, one can see the cable return.

Cap 39 is the roller, affixed to the carriage by means of bolts 40, so as to enable assembly in the rail.

What is claimed is:

1. Gallows for sport gymnastics having a rigid ring suspension which is adapted for training exercises and competitive events, comprising:

a relatively flexible cross beam;

a plurality of uprights;

elastic blocks journally connecting said cross beam to said plurality of uprights;

at least one ring;

at least one rigid rod having a top and a bottom;

at least one self-locking trunnion including a universal joint, said universal joint being connected to the top of said rigid rod; and at least one attaching member connecting said at least one ring to the bottom of said at least one rigid rod;

wherein said at least one self-locking trunnion is constructed and arranged to prevent turning of said at least one self-locking trunnion when a load is not suspended on said at least one ring, and to permit turning of said at least one self-locking trunnion when a load is suspended on said at least one ring.

2. The gallows according to claim 1, wherein a cable connects lower ends of said plurality of uprights to prevent spreading of said plurality of uprights.

3. The gallows according to claim 1, wherein said cross beam is relatively long.

4. The gallows according to claim 1, wherein said elastic blocks comprise male caps affixed to said plurality of uprights, an elastic block member housed within each of said male caps and extending slightly from sides of each of said male caps, and a metallic spacer contained within each said elastic block member.

5. The gallows according to claim 4, including female caps on said cross beam corresponding in number to said male caps, and said female caps including means forming an aperture for permitting a bolt to be inserted for fixing said female cap to said male caps.

6. The gallows according to claim 5, wherein said elastic block member is composed of rubber.

7. The gallows according to claim 1, wherein said at least one self-locking trunnion comprises a brake mechanism, a spring and a thrush ball bearing constructed and arranged so that, when no load is suspended on said at least one ring, spring tension causes said brake mechanism to contact an upper portion of said at least one self-locking trunnion to prevent turning thereof, and, when a load is suspended on said at least one ring, said thrust ball bearing compresses said spring to permit turning of said at least one self-locking trunnion.

8. The gallows according to claim 7, wherein said brake mechanism includes a brake washer and a friction washer.

9. The gallows according to claim 8, further including a nut and a counter nut on said at least one self-locking trunnion to enable adjustment of tension on said spring.

10. The gallows according to claim 1, including a rigid rail fixed on said uprights, said cross beam being mounted below said rigid rail, two carriages displaceably mounted on said rigid rail, each of said two carriages including a roller slidable along said cross beam to adjust flexibility of said cross beam.

11. The gallows according to claim 10, wherein said cross beam is positioned immediately above said roller.

12. The gallows according to claim 11, wherein said roller is composed of rubber.

13. The gallows according to claim 10, wherein each of said two carriages includes a block of plastic foam therein to eliminate backlash and noise.

14. The gallows according to claim 13, wherein said block of plastic foam is composed of polyurethane.

15. The gallows according to claim 10, including a cable permitting adjustment of the position of said two carriages.

16. The gallows according to claim 15, wherein said rigid rail comprises two ends, a horizontal pulley located at one end of said rigid rail, two vertical pulleys located at the other end of said rigid rail, and a low pulley located within reach on one of said uprights, and said cable is connected on a close circuit on said horizontal pulley, said two vertical pulleys and said low pulley to permit symmetrical adjustment of said two carriages.

17. The gallows according to claim 16, further including a graduated scale close to said low pulley.

18. The gallows according to claim 16, wherein said rigid rail houses the entire displacement mechanism of said two carriages.

19. The gallows according to claim 1, wherein said at least one attaching member comprises a short link composes of textile material.

20. The gallows according to claim 1, wherein said at least one ring comprises two rings.

* * * * *

UNITED STATES PATENT AND TRADEMARK OFFICE

CERTIFICATE OF CORRECTION

PATENT NO. : 5,330,398
DATED : July 19, 1994
INVENTOR(S) : Gerard BARBAFIERI et al.

It is certified that error appears in the above-indentified patent and that said Letters Patent is hereby corrected as shown below:

At column 1, between lines 32 and 33, insert ---SUMMARY OF THE INVENTION---.

At column 6, line 5 (claim 19, line 2), change "composes" to ---composed---.

Signed and Sealed this

Seventh Day of March, 1995

*Attest:*

*Attesting Officer*

BRUCE LEHMAN

*Commissioner of Patents and Trademarks*